US012178249B2

(12) United States Patent
Ghanouni

(10) Patent No.: US 12,178,249 B2
(45) Date of Patent: Dec. 31, 2024

(54) AEROSOL GENERATION

(71) Applicant: NICOVENTURES TRADING LIMITED, London (GB)

(72) Inventor: Kav Ghanouni, London (GB)

(73) Assignee: NICOVENTURES TRADING LIMITED, London (GB)

( * ) Notice: Subject to any disclaimer, the term of this patent is extended or adjusted under 35 U.S.C. 154(b) by 854 days.

(21) Appl. No.: 17/250,499

(22) PCT Filed: Jul. 31, 2019

(86) PCT No.: PCT/EP2019/070708
§ 371 (c)(1),
(2) Date: Jan. 28, 2021

(87) PCT Pub. No.: WO2020/025713
PCT Pub. Date: Feb. 6, 2020

(65) Prior Publication Data

US 2021/0298358 A1 Sep. 30, 2021

(30) Foreign Application Priority Data

Jul. 31, 2018 (GB) ..... 1812507

(51) Int. Cl.
*A24F 40/46* (2020.01)
*A24B 3/14* (2006.01)
(Continued)

(52) U.S. Cl.
CPC ..... *A24F 40/46* (2020.01); *A24B 15/167* (2016.11); *A24D 1/002* (2013.01); *A24D 1/20* (2020.01); *A24F 40/20* (2020.01); *A24F 40/465* (2020.01)

(58) Field of Classification Search
None
See application file for complete search history.

(56) References Cited

U.S. PATENT DOCUMENTS 9,609,894 B2 4/2017 Abramov et al.
2014/0338680 A1* 11/2014 Abramov ..... A24F 40/46 131/328
(Continued)

FOREIGN PATENT DOCUMENTS

CN 103763954 A 4/2014
CN 104770885 A 7/2015
(Continued)

OTHER PUBLICATIONS

Office Action received for Korean Patent Application No. 10-2021-7005922, mailed on Jan. 2, 2023, 14 pages (8 pages of English Translation and 6 pages of Official Copy).
(Continued)

*Primary Examiner* — Philip Y Louie
*Assistant Examiner* — Madeleine P Delacruz
(74) *Attorney, Agent, or Firm* — WOMBLE BOND DICKINSON (US) LLP

(57) ABSTRACT

Described herein is a method of generating aerosol from an aerosol-generating substrate using an aerosol-generating device, the aerosol-generating device comprising at least three heating zones disposed so as to each heat a different section of the substrate to generate an aerosol without burning. The method comprises sequentially generating aerosol from each different section of substrate, wherein during heating; (i) a section of substrate is heated to an aerosol-generation temperature; (ii) another section of substrate which is heated to an intermediate temperature which is below the aerosol-generation temperature but and approximately equal to or above the minimum operating temperature; (iii) at least one of the remaining sections of substrate are heated to a minimum operating temperature which is at least sufficient to prevent condensation of volatilized components on or in the vicinity of those sections;
(Continued)

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

15 Claims, 5 Drawing Sheets

(51) Int. Cl.

| | |
|---|---|
| ***A24B 15/14*** | (2006.01) |
| ***A24B 15/167*** | (2020.01) |
| ***A24B 15/30*** | (2006.01) |
| ***A24B 15/42*** | (2006.01) |
| ***A24D 1/00*** | (2020.01) |
| ***A24D 1/20*** | (2020.01) |
| ***A24F 40/20*** | (2020.01) |
| ***A24F 40/465*** | (2020.01) |
| ***A24F 40/57*** | (2020.01) |

(56) References Cited

U.S. PATENT DOCUMENTS

| | | | | |
|---|---|---|---|---|
| 2016/0295922 | A1* | 10/2016 | John | A24F 40/46 |
| 2017/0143042 | A1 | 5/2017 | Batista et al. | |
| 2017/0156406 | A1* | 6/2017 | Abramov | A24F 40/57 |
| 2017/0164659 | A1* | 6/2017 | Schneider | A24F 40/46 |

FOREIGN PATENT DOCUMENTS

| | | | | |
|---|---|---|---|---|
| CN | 106255431 | A | 12/2016 | |
| CN | 106535680 | A | 3/2017 | |
| CN | 107231790 | A | 10/2017 | |
| CN | 107259647 | A | 10/2017 | |
| CN | 107846963 | A | 3/2018 | |
| EP | 0589298 | A1 | 3/1994 | |
| EP | 2327318 | A1 | 6/2011 | |
| EP | 2609821 | A1 * | 7/2013 | A24F 3/02 |
| JP | 2018-504127 | A | 2/2018 | |
| JP | 2018-061512 | A | 4/2018 | |
| JP | 2018515119 | A | 6/2018 | |
| KR | 10-2014-0070543 | A | 6/2014 | |
| KR | 10-2015-0030733 | A | 3/2015 | |
| RU | 2595971 | C2 | 8/2016 | |
| RU | 2614615 | C2 | 3/2017 | |
| WO | WO2013034460 | A1 | 3/2013 | |
| WO | 2015062983 | A2 | 5/2015 | |
| WO | WO2015166245 | A2 | 11/2015 | |
| WO | WO2015172224 | A1 | 11/2015 | |
| WO | 2016135331 | A1 | 9/2016 | |
| WO | 2017/186946 | A1 | 11/2017 | |
| WO | WO2017207674 | A1 | 12/2017 | |
| WO | 2018019543 | A1 | 2/2018 | |
| WO | 2018019738 | A1 | 2/2018 | |
| WO | 2018019855 | A1 | 2/2018 | |
| WO | 2018054793 | A1 | 3/2018 | |
| WO | 2018/134159 | A1 | 7/2018 | |
| WO | WO-2019030353 | A1 * | 2/2019 | A24F 40/465 |

OTHER PUBLICATIONS

International Search Report and Written Opinion, International Application No. PCT/EP2019/070708, mailing date Oct. 12, 2019, 17 pages.

International Preliminary Report on Patentability received for PCT Patent Application No. PCT/EP2019/070708, mailed on Feb. 11, 2021, 10 pages.

Office Action received for Chinese Patent Application No. 201980051033.X, mailed on Feb. 23, 2022, 31 pages (16 pages of English Translation and 15 pages of Official Copy).

Office Action received for Russian Patent Application No. 2021104417, mailed on Nov. 28, 2022, 11 pages (3 pages of English Translation and 8 pages of Official Copy).

* cited by examiner

AEROSOL GENERATION

CROSS-REFERENCE TO RELATED APPLICATIONS

The present application is a National Phase entry of PCT Application No. PCT/EP2019/070708, filed Jul. 31, 2019, which claims priority from Great Britain Patent Application No. 1812507.0 filed Jul. 31, 2018, each of which is fully incorporated herein by reference.

TECHNICAL FIELD

The present invention relates to aerosol generation.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles or aerosol generating assemblies.

One example of such a product is a heating device which release compounds by heating, but not burning, a solid aerosolizable material. This solid aerosolizable material may, in some cases, contain a tobacco material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosolizable material are known.

As another example, there are e-cigarette/tobacco heating product hybrid devices, also known as electronic tobacco hybrid devices. These hybrid devices contain a liquid source (which may or may not contain nicotine) which is vaporized by heating to produce an inhalable vapor or aerosol. The device additionally contains a solid aerosolizable material (which may or may not contain a tobacco material) and components of this material are entrained in the inhalable vapor or aerosol to produce the inhaled medium.

SUMMARY

A first aspect of the invention provides a method of generating aerosol from an aerosol-generating substrate using an aerosol-generating device, the aerosol-generating device comprising at least three heating zones disposed so as to each heat a different section of the substrate to generate an aerosol without burning;

the method comprising sequentially generating aerosol from each different section of substrate, wherein during heating;

(i) a section of substrate is heated to an aerosol-generation temperature;

(ii) another section of substrate which is heated to an intermediate temperature which is below the aerosol-generation temperature and approximately equal to or above the minimum operating temperature;

(iii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

A second aspect of the invention provides an aerosol-generating device for generating aerosol from an aerosol-generating substrate by heating the substrate without burning, wherein the device comprises at least three heating zones, each disposed to heat a different section of the aerosol-generating substrate, wherein the device is configured such that in use;

(i) a section of substrate is heated to an aerosol-generation temperature;

(ii) another section of substrate which is heated to an intermediate temperature which is below the aerosol-generation temperature and approximately equal to or above the minimum operating temperature;

(iii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

In further aspects of the invention, there is provided a modification to the above method and device, in which the aerosol is generated sequentially from each different section of substrate from the most upstream section to the most downstream section (where upstream and downstream refer to the direction of aerosol flow in use), wherein once aerosol has been generated from a section, (a) the temperature in that section is reduced to an ambient temperature (where no heat is provided to that section), (b) the section previously heated to the intermediate temperature is heated to the aerosol-generation temperature, and (c) a further section is heated to the intermediate temperature.

A further aspect of the invention provides a method of generating aerosol from an aerosol-generating substrate using an aerosol-generating device, the aerosol-generating substrate comprising an amorphous solid material, the aerosol-generating device comprising at least two heating zones disposed so as to each heat a different section of the substrate to generate an aerosol without burning;

the method comprising sequentially generating aerosol from each different section of substrate, wherein during heating;

(i) a section of substrate is heated to an aerosol-generation temperature;

(ii) at least one of the remaining sections of substrate are heated to a minimum operating temperature which is at least sufficient to prevent condensation of volatilized (iii) components on or in the vicinity of those sections;

and wherein once aerosol has been generated from a section, (a) the temperature in that section is reduced from the aerosol-generation temperature to the minimum operating temperature, and (b) a further section is heated to the aerosol-generation temperature.

A further aspect of the invention provides an aerosol-generating device for generating aerosol from an aerosol-generating substrate by heating the substrate without burning, the aerosol-generating substrate comprising an amorphous solid material, wherein the device comprises at least two heating zones, each disposed to heat a different section of the aerosol-generating substrate, wherein the device is configured such that in use;

(i) a section of substrate is heated to an aerosol-generation temperature;

(ii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, and (b) a further section is heated to the aerosol-generation temperature.

In further aspects of the invention, there is provided a modification to the above method and device, in which the aerosol is generated sequentially from each different section of substrate from the most upstream section to the most downstream section (where upstream and downstream refer to the direction of aerosol flow in use), wherein once aerosol has been generated from a section, (a) the temperature in that section is reduced to an ambient temperature (where no heat is provided to that section), and (b) a further section is heated to the aerosol-generation temperature.

The invention also provides an aerosol-generating assembly comprising an aerosol-generating device according to the above embodiments, and an aerosol-generating substrate.

Further aspects of the invention provide the use of the aerosol generating device of the aerosol generating assembly in the generation of an inhalable aerosol.

Further features and advantages of the invention will become apparent from the following description, given by way of example only, and with reference to the accompanying figure.

DETAILED DESCRIPTION OF THE DRAWINGS

As described above, the invention provides a method of generating aerosol from an aerosol-generating substrate using an aerosol-generating device, the aerosol-generating device comprising at least three heating zones disposed so as to each heat a different section of the substrate to generate an aerosol without burning;

the method comprising sequentially generating aerosol from each different section of substrate, wherein during heating;

(i) a section of substrate is heated to an aerosol-generation temperature;

(ii) another section of substrate which is heated to an intermediate temperature which is below the aerosol-generation temperature and approximately equal to or above the minimum operating temperature;

(iii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

Throughout this specification, reference to "at least one of the remaining sections" should be taken to explicitly disclose a corresponding embodiment in which "all of the remaining sections" are referenced.

In particular cases, there is provided a method of generating aerosol from an aerosol-generating substrate using an aerosol-generating device, the aerosol-generating device comprising at least three heating zones disposed so as to each heat a different section of the substrate to generate an aerosol without burning;

the method comprising sequentially generating aerosol from each different section of substrate, wherein during heating;

(iv) a section of substrate is heated to an aerosol-generation temperature;

(v) another section of substrate which is heated to an intermediate temperature which is below the aerosol-generation temperature but above the minimum operating temperature;

(vi) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

Figure 4:
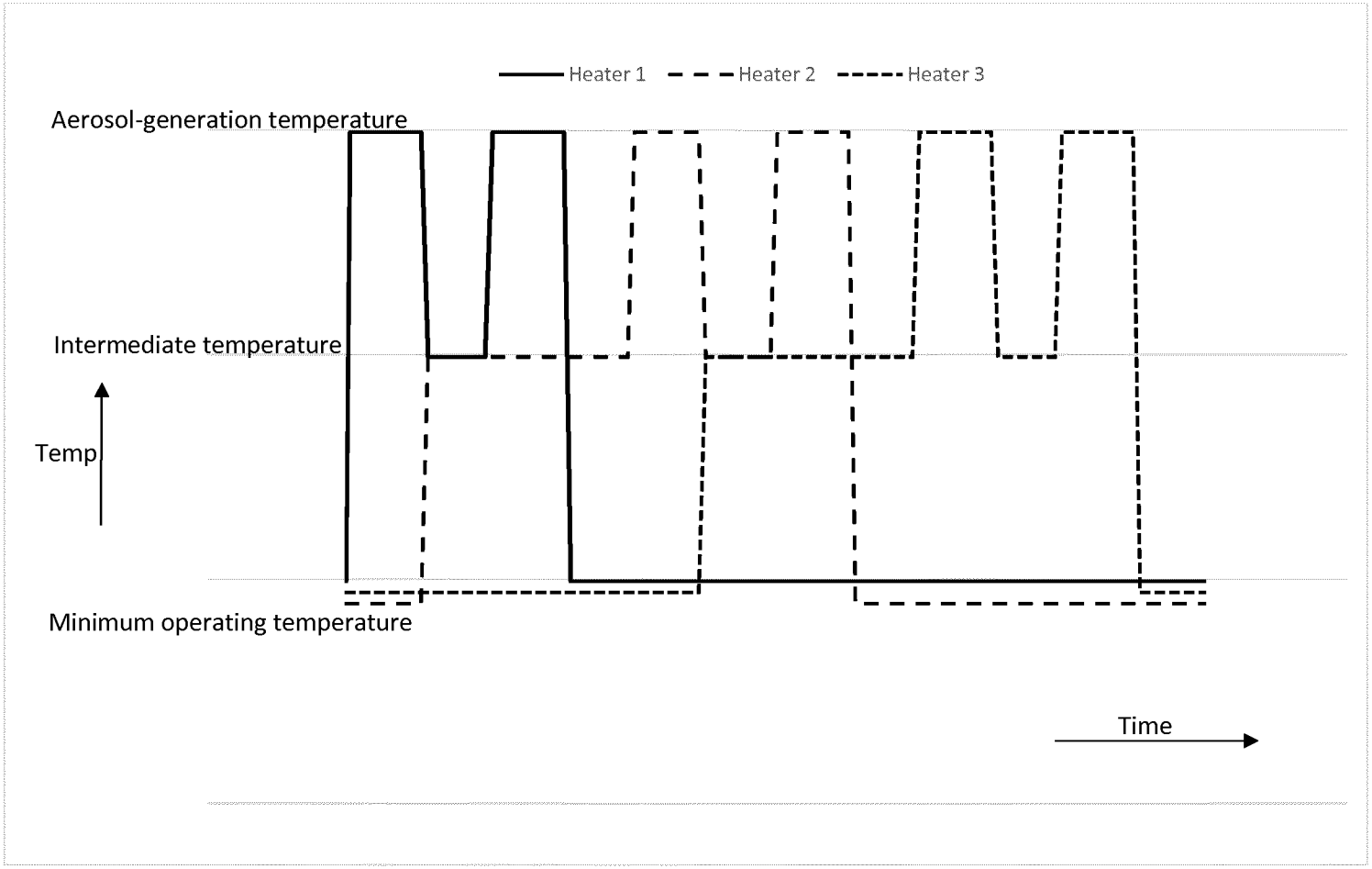
FIG. 4 shows another example of a heating profile for a device including 3 heating zones.

In particular cases, the intermediate temperature is above the minimum operating temperature. Typically, in these cases, at any given time, there will be one section at the aerosol-generation temperature and one section at the intermediate temperature, with all other sections at the minimum operating temperature. However, when the final section is heated to the aerosol-generation temperature, all other sections are at the minimum operating temperature. (However, there are exceptions to this typical profiling that fall within the scope of the claims, as illustrated in FIG. 4.)

The inventors have established that this heating profile provides good aerosol delivery to the user whilst optimizing power consumption:

The minimum operating temperature ensures that volatilized/aerosolized components of the substrate do not condense and are delivered to the user in the intended manner.

The section of substrate that is to be aerosolized next in sequence is heated to an intermediate temperature. In particular embodiments wherein the intermediate temperature is above the minimum operating temperature, this allows aerosol delivery from that section to be initiated more rapidly than if it were held at the minimum operating temperature, since the temperature difference between the aerosol-generation temperature and the intermediate temperature is less than the difference between the aerosol-generation temperature and the minimum operating temperature. Rapid generation of aerosol provides a good puff profile.

Only the section of substrate that is being aerosolized is heated to the aerosol-generation temperature, optimizing power consumption.

In some cases, the aerosol-generation temperature may be in the range of about 120° C. to about 350° C., suitably from about 150° C., 160° C., 180° C. or 200° C. to about 300° C., 250° C., 230° C., 220° C., 200° C., or 180° C. In some cases, the aerosol-generation temperature may be from about 190° C. to about 300° C., or from about 200° C. to 280° C., or from about 210° C. to about 270° C., or from about 220° C. to about 260° C.

In some cases, the intermediate temperature may be in the range of about 50° C. to about 170° C., suitably from about 90° C. or 100° C. to about 160° C. or 130° C. In some cases, the intermediate temperature may be in the range of about 30° C. to about 140° C., suitably from about 50° C., 70° C. or 100° C. to about 130° C. or 120° C.

In some cases, the minimum operating temperature may be in the range of about 50° C. to about 170° C., suitably from about 90° C. or 100° C. to about 160° C. or 130° C. In some cases, the minimum operating temperature may be in the range of about 30° C. to about 120° C., suitably from about 35° C. or 50° C. to about 100° C. or 80° C.

In some cases, the minimum operating temperature is approximately equal to the intermediate temperature. In other cases, the minimum operating temperature is less than the intermediate temperature.

In some cases, each different or discrete section of the substrate provides aerosol for one puff. In some cases, changing of the temperature in a heating zone may be puff actuated.

Figure 1:
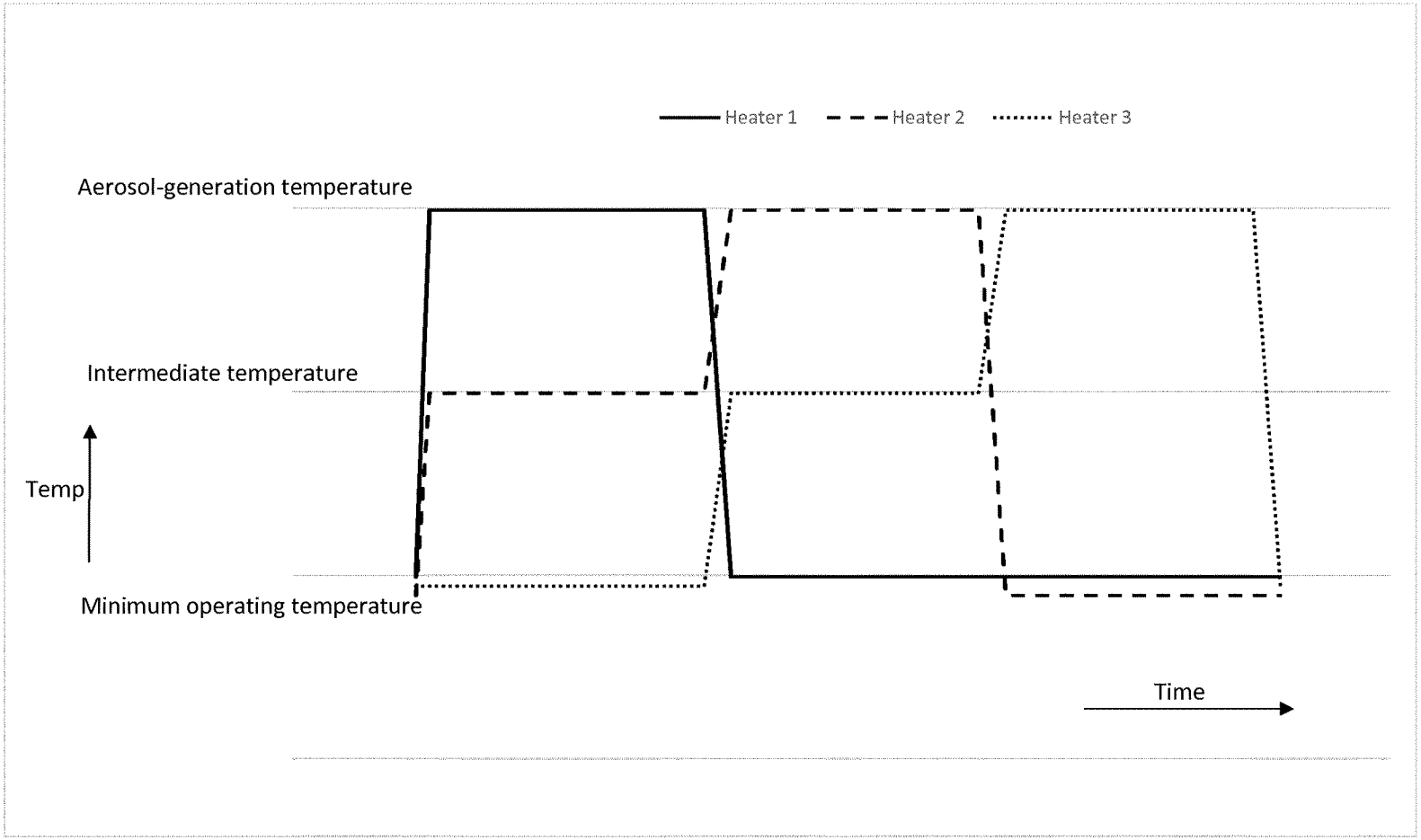
FIG. 1 shows an example of a heating profile for a device including 3 heating zones.

Referring now to FIG. 1, there is shown a heating profile according to the invention for a device comprising three heating zones for heating three different sections of aerosol-generating substrate. Initially, a first section is heated to the aerosol-generation temperature, a second section is heated to the intermediate temperature and the third section is warmed to the minimum operating temperature.

Subsequently, the second section is heated to the aerosol-generation temperature, the third section is heated to the intermediate temperature and the first section is cooled to the minimum operating temperature.

Finally, the third section is heated to the aerosol-generation temperature while the first and second sections are held at the minimum operating temperature.

Figure 2:
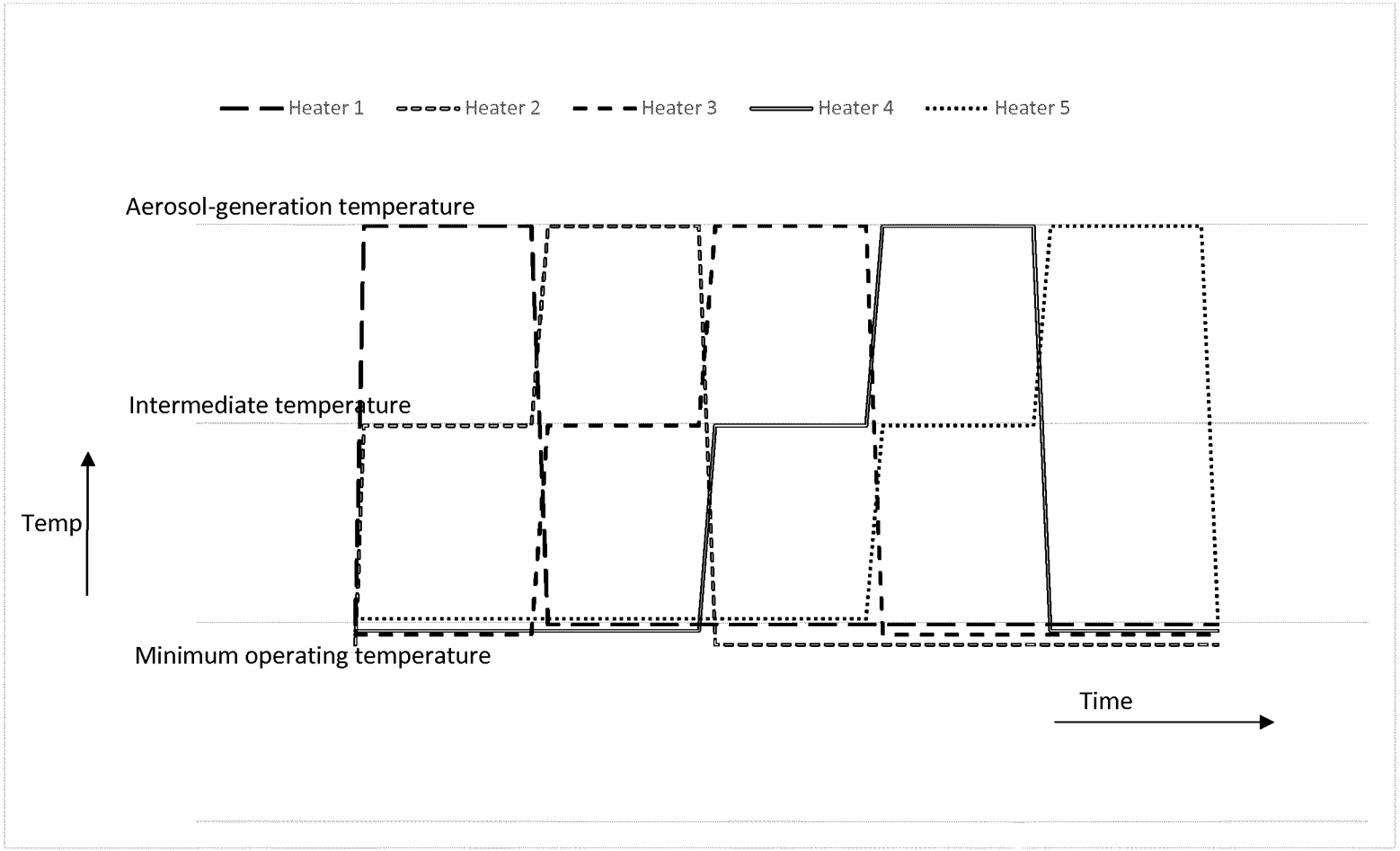
FIG. 2 shows an example of a heating profile for a device including 5 heating zones.

Referring now to FIG. 2, there is shown a heating profile according to the invention for a device comprising five heating zones. Initially, a first section is heated to the aerosol-generation temperature, a second section is heated to the intermediate temperature and the third, fourth and fifth sections are warmed to the minimum operating temperature.

Subsequently, the second section is heated to the aerosol-generation temperature, the third section is heated to the intermediate temperature and the first, fourth and fifth sections are at the minimum operating temperature.

Next, the third section is heated to the aerosol-generation temperature, the fourth section is heated to the intermediate temperature and the first, second and fifth sections are at the minimum operating temperature.

Then, the fourth section is heated to the aerosol-generation temperature, the fifth section is heated to the intermediate temperature and the first, second and third sections are at the minimum operating temperature.

Finally, the fifth section is heated to the aerosol-generation temperature while the other sections are held at the minimum operating temperature.

Although not illustrated, the sequential heating pattern illustrated in these figures can be extended to any number of heating zones.

In all figures the minimum operating temperature for all sections is the same. The lines are slightly separated simply for ease of representation.

In some cases, each different or discrete section of the substrate provides aerosol for two or more puffs.

Figure 3:
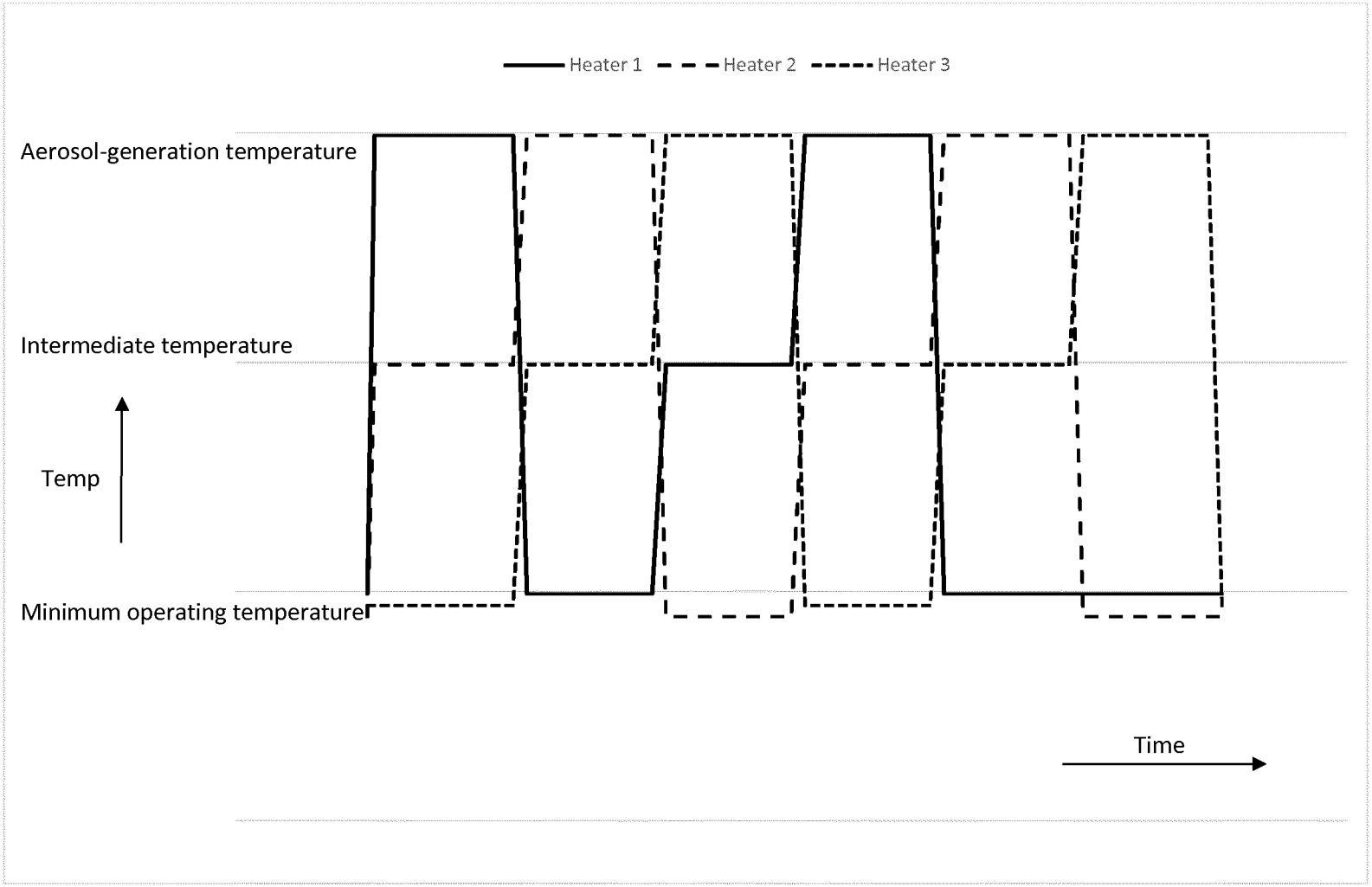
FIG. 3 shows another example of a heating profile for a device including 3 heating zones.

Referring now to FIG. 3, there is shown a heating profile according to the invention for a device comprising three heating zones for heating three different sections of aerosol-generating substrate. Each section of aerosol-generating substrate provides two puffs to the user. The heating profile illustrated in FIG. 1 is effectively repeated twice, so that the heating zones reach the aerosol-generation temperature in the pattern ABCABC. That is, initially, a first section is heated to the aerosol-generation temperature, a second section is heated to the intermediate temperature and the third section is warmed to the minimum operating temperature.

Subsequently, the second section is heated to the aerosol-generation temperature, the third section is heated to the intermediate temperature and the first section is cooled to the minimum operating temperature.

Next, the third section is heated to the aerosol-generation temperature while the first section is at the intermediate temperature and the second section is at the minimum operating temperature.

Then, the first section is heated to the aerosol-generation temperature, the second section is heated to the intermediate temperature and the third section is at the minimum operating temperature.

Subsequently, the second section is heated to the aerosol-generation temperature, the third section is heated to the intermediate temperature and the first section is cooled to the minimum operating temperature.

Finally, the third section is heated to the aerosol-generation temperature while the first and second sections are at the minimum operating temperature.

Referring now to FIG. 4 there is shown a heating profile according to the invention for a device comprising three heating zones for heating three different sections of aerosol-generating substrate. Each section of aerosol-generating substrate provides two puffs to the user. In contrast to the profile shown in FIG. 3, the puffs are provided in the pattern AABBCC.

Two puffs can of course be provided from each section using the heat profile illustrated in FIG. 1. In the profile of FIG. 4, the FIG. 1 profile is modified so that the temperature of the section providing aerosol drops to the intermediate temperature between puffs. This improves heating efficiency and power consumption. Moreover, the subsequent section to be heated is raised to the intermediate temperature after the first puff has been provided from the aerosol-generating section. This also improves heating efficiency and power consumption.

Figure 5:
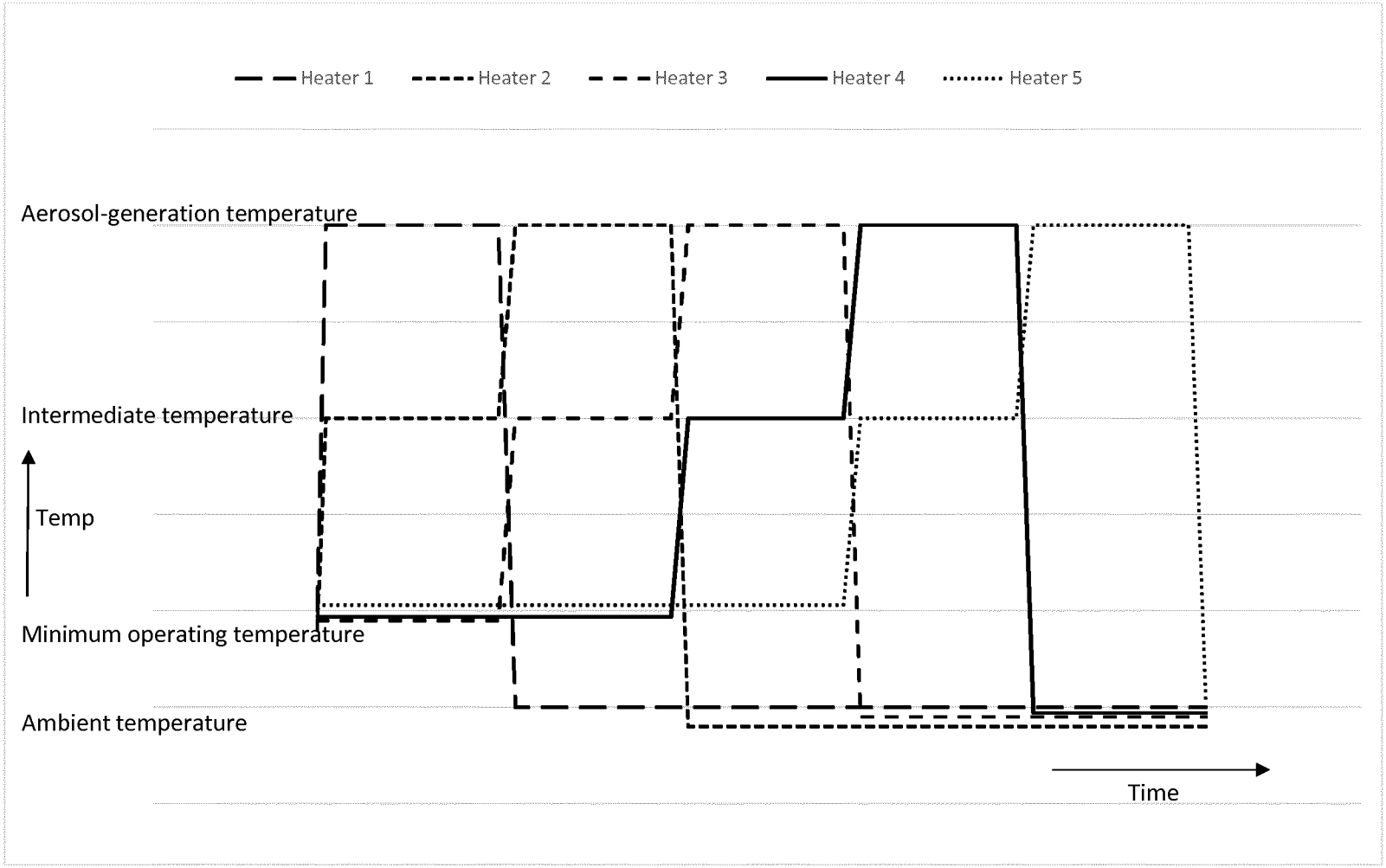
FIG. 5 shows an example of a heating profile for a device including 5 heating zones.

In a modification on the above method, the invention provides an alternative embodiment, in which the aerosol is generated sequentially from each different section of substrate from the most upstream section to the most downstream section (where upstream and downstream refer to the direction of aerosol flow in use), wherein in this alternative case, once aerosol has been generated from a section, (a) the temperature in that section is reduced to an ambient temperature (where no heat is provided to that section), (b) the section previously heated to the intermediate temperature is heated to the aerosol-generation temperature, and (c) a further section is heated to the intermediate temperature. Such an embodiment is illustrated in FIG. 5, which shows a modification of the embodiment illustrated in FIG. 2.

In some cases, the substrate comprises an amorphous solid, which may alternatively be referred to as a "monolithic solid" (i.e. non-fibrous) or as a "dried gel". The amorphous solid is a solid material that may retain some fluid, such as liquid, within it. The amorphous solid may form part of an aerosol-forming material which may, in some cases, comprise amorphous solid in an amount from about 50 wt %, 60 wt % or 70 wt % to about 90 wt %, 95 wt % or 100 wt %. In some cases, the aerosol-forming material consists of amorphous solid.

The inventors have found that amorphous solids may provide rapid aerosol delivery, and are particularly suitable for use in conjunction with the heating profile described herein. In traditional heat-not-burn products and hybrid devices, solid tobacco-containing material is heated; in order to provide sufficient aerosol delivery this is necessarily bulky and must be heated for a long period of time in order to volatilize all components. In contrast, amorphous aerosol-generating solids can contain aerosolizable components at higher concentrations and may therefore be included as thin layers of material; volatilization occurs faster and aerosol generation is therefore quicker. As such, amorphous aerosol-generating solid materials are particularly suitable for use with a heating profile that heats sections of the material to the aerosol-generation temperature for relatively short periods, such as for the duration of a single puff.

In some cases, the amorphous solid comprises:

1-60 wt % of a gelling agent; and/or 5-80 wt % of an aerosol generating agent; and/or 0.1-60 wt % of at least one active substance and/or flavorant;

wherein these weights are calculated on a dry weight basis (DWB).

In some cases, the amorphous solid comprises:

1-60 wt % of a gelling agent; and/or 5-80 wt % of an aerosol generating agent; and/or 10-60 wt % of a tobacco extract;

wherein these weights are calculated on a dry weight basis (DWB).

The inventors have found that amorphous solids having these compositions can be efficiently heated to generate an inhalable aerosol. Further features of the amorphous solid are discussed below in more detail.

As noted above, the invention also provides an aerosol-generating device for generating aerosol from an aerosol-generating substrate by heating the substrate without burning, wherein the device comprises at least three heating zones, each disposed to heat a different of the aerosol-generating substrate, wherein the device is configured such that in use;

(i) a section of substrate is heated to an aerosol-generation temperature;

(ii) another section of substrate which is heated to an intermediate temperature which is below the aerosol-generation temperature and approximately equal to or above the minimum operating temperature;

(iii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

The device may be configured or programmed to provide a heating profile according to the method aspect of the invention.

In some cases, the device comprises 4, 5, 6, 7, 8 or 9 heating zones, each disposed to heat a different of the aerosol-generating substrate in use.

In some cases, the device may comprise a puff sensor and the changing of the temperature in a heating zone may be puff actuated.

In some cases, the device is configured to heat a solid aerosol-generating substrate.

The invention also provides an aerosol-generating assembly comprising an aerosol-generating device described above and an aerosol-generating substrate.

In some cases, each different section of the substrate (that are heated sequentially in use) provides aerosol for one puff. In some cases, each section provides aerosol for two or more puffs (which may provide for a more compact assembly).

In some cases, the substrate comprises an amorphous solid.

In some cases, the aerosol generating assembly may be a heat-not-burn device. That is, it may contain a solid tobacco-containing material (and no liquid aerosolizable material). In some cases, the amorphous solid may comprise the tobacco material. A heat-not-burn device is disclosed in WO 2015/062983 A2, which is incorporated by reference in its entirety.

In some cases, the aerosol generating assembly may be an electronic tobacco hybrid device. That is, it may contain a solid aerosolizable material and a liquid aerosolizable material. In some cases, the amorphous solid may comprise nicotine. In some cases, the amorphous solid may comprise a tobacco material. In some cases, the amorphous solid may comprise a tobacco material and a separate nicotine source. The separate aerosolizable materials may be heated by separate heaters, the same heater or, in one case, a downstream aerosolizable material may be heated by a hot aerosol which is generated from the upstream aerosolizable material. An electronic tobacco hybrid device is disclosed in WO 2016/135331 A1, which is incorporated by reference in its entirety.

In some cases, the assembly may additionally comprise a filter and/or cooling element. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug.

In some cases, there may be a plurality of heaters in the device which are configured to heat the aerosolizable material without burning. For example, there may be one heater per heating zone. In some cases, there may be 3, 4, 5, 6, 7, 8, 9, etc. heaters. In one case, there are at least three heaters present in the device. In such cases, the heaters may be the same type or different types of heater. The heaters may electrically resistive heaters or induction heaters, for example. Each heater may be a combustible heat source or a chemical heat source which undergoes an exothermic reaction to product heat in use.

In some cases in use, substantially all of each portion of amorphous solid is less than about 4 mm, 3 mm, 2 mm or 1 mm from the heater(s). In some cases, each portion of solid is disposed between about 0.010 mm and 2.0 mm from the heater(s), suitably between about 0.02 mm and 1.0 mm, suitably 0.1 mm to 0.5 mm. These minimum distances may, in some cases, reflect the thickness of a carrier that supports the amorphous solid. In some cases, a surface of the amorphous solid may directly abut the heater(s).

The aerosol-generating assembly may additionally comprise ventilation apertures. These may be provided in the filter and/or cooling element. These apertures may allow cool air to be drawn into the assembly during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

For the avoidance of doubt, the assembly may include the substrate positioned ready for heating by the device, or otherwise. In some cases, the assembly may provide the substrate within the device, and in other cases, may comprise the device and a separate substrate which is inserted into the device in use.

As noted above, the invention provides an alternative method of generating aerosol from an aerosol-generating substrate using an aerosol-generating device, in which the aerosol-generating substrate comprises an amorphous solid material, the aerosol-generating device comprises at least two heating zones disposed so as to each heat a different section of the substrate to generate an aerosol without burning;

wherein the method comprises sequentially generating aerosol from each different section of substrate, wherein during heating;

(i) a section of substrate is heated to an aerosol-generation temperature;

(ii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, and (b) a further section is heated to the aerosol-generation temperature.

Typically, at any given time, there will be one section at the aerosol-generation temperature and all other sections are at the minimum operating temperature. The inventors have established that this heating profile provides good aerosol delivery to the user whilst optimizing power consumption:

The minimum operating temperature ensures that volatilized/aerosolized components of the substrate do not condense and are delivered to the user in the intended manner. This warming of the substrate to the minimum operating temperatures allows aerosol delivery from the next section to be volatilized to be initiated more rapidly than if the section were at ambient temperature. Rapid generation of aerosol provides a good puff profile.

Only the section of substrate that is being aerosolized is heated to the aerosol-generation temperature, optimizing power consumption.

In some cases, the aerosol-generation temperature may be in the range of about 120° C. to about 350° C., suitably from about 150° C., 160° C., 180° C. or 200° C. to about 300° C., 250° C., 230° C., 220° C., 200° C., or 180° C. In some cases, the aerosol-generation temperature may be from about 190° C. to about 300° C. In some cases, the aerosol-generation temperature may be from about 230° C. to about 250° C., suitably about 240° C.

In some cases, the minimum operating temperature may be in the range of about 30° C. to about 170° C., suitably from about 35° C. or 50° C. to about 160° C., 150° C., 100° C. or 80° C. In some cases, the minimum operating temperature may be in the range of about 30° C. to about 120° C., suitably from about 30° C., 35° C., 40° C. or 50° C. to about 100° C., 80° C. 60° C. or 55° C.

In a modification on the above method, the invention provides an alternative embodiment, in which the aerosol is generated sequentially from each different section of substrate from the most upstream section to the most downstream section (where upstream and downstream refer to the direction of aerosol flow in use), wherein in this alternative case, once aerosol has been generated from a section, (a) the temperature in that section is reduced to an ambient temperature (where no heat is provided to that section), and (b) a further section is heated to the aerosol-generation temperature.

For the avoidance of doubt, features described above in relation to the other embodiments are explicitly disclosed in combination with these embodiments, to the extent that they are compatible.

The invention also provides an aerosol-generating device for generating aerosol from an aerosol-generating substrate by heating the substrate without burning, the aerosol-generating substrate comprising an amorphous solid material, wherein the device comprises at least two heating zones, each disposed to heat a different section of the aerosol-generating substrate, wherein the device is configured such that in use;

(i) a section of substrate is heated to an aerosol-generation temperature;

(ii) at least one of the remaining sections of substrate are heated to a minimum operating temperature which is at least sufficient to prevent condensation of volatilized components on or in the vicinity of those sections;

and wherein once aerosol has been generated from a section, (a) the temperature in that section is reduced from the aerosol-generation temperature to the minimum operating temperature, and (b) a further section is heated to the aerosol-generation temperature.

For the avoidance of doubt, features described above in relation to the other embodiments are explicitly disclosed in combination with this embodiment, to the extent that they are compatible.

Amorphous Solid Material Composition and Manufacture

As noted above, in some cases the aerosol generating substrate comprises an amorphous solid, which itself comprises:

1-60 wt % of a gelling agent; and/or 5-80 wt % of an aerosol generating agent; and/or 0.1-60 wt % of at least one active substance and/or flavorant;

wherein these weights are calculated on a dry weight basis (DWB).

In some cases the aerosol generating substrate comprises an amorphous solid, which itself comprises:

1-60 wt % of a gelling agent; and/or 5-80 wt % of an aerosol generating agent; and/or 10-60 wt % of a tobacco extract;

wherein these weights are calculated on a dry weight basis (DWB).

The amorphous solid may, in some cases, be a hydrogel and comprises less than about 20 wt %, 15 wt %, 12 wt % or 10 wt % of water calculated on a wet weight basis (WWB). In some cases, the amorphous solid may comprise at least about 1 wt %, 2 wt % or 5 wt % of water (WWB). The amorphous solid may comprise about 10 wt % water.

In some cases, the amorphous solid may comprise from about 1 wt %, 5 wt %, 10 wt %, 15 wt % or 20 wt % to about 80 wt %, 70 wt %, 60 wt %, 50 wt %, 40 wt %, 30 wt % or 25 wt % of a gelling agent (DWB). For example, the amorphous solid may comprise 1-50 wt %, 10-40 wt %, 15-30 wt % or 20-25 wt % of a gelling agent (DWB).

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

The amorphous solid may comprise from about 5 wt %, 10 wt % 20 wt %, 25 wt %, 27 wt % or 30 wt % to about 80 wt %, 70 wt % 60 wt %, 55 wt %, 50 wt %, 45 wt %, 40 wt %, or 35 wt % of an aerosol generating agent (DWB). The aerosol generating agent may act as a plasticizer. For example, the amorphous solid may comprise 10-60 wt %, 25-40 wt % or 30-35 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticizer is too high, the amorphous solid may absorb water (as the aerosol generating agent is hygroscopic) resulting in a material that does not create an appropriate consumption experience in use. The inventors have established that if the plasticizer content is too low, the amorphous solid may be brittle and easily broken. The plasticizer content specified herein provides an amorphous solid flexibility which allows the amorphous solid sheet to be wound onto a bobbin, which is useful in manufacture of aerosol generating articles.

In some cases, the amorphous solid additionally comprises an active substance. For example, in some cases, the amorphous solid additionally comprises a tobacco material and/or nicotine. For example, the amorphous solid may additionally comprise powdered tobacco and/or nicotine and/or a tobacco extract. In some cases, the amorphous solid may comprise from about 0.1 wt %, 1 wt %, 5 wt %, 10 wt %, 15 wt %, 20 wt % or 25 wt % to about 70 wt %, 50 wt %, 45 wt % or 40 wt % (calculated on a dry weight basis) of active substance.

The amorphous solid may comprise from about 1 wt %, 10 wt %, 20 wt %, 30 wt %, 40 wt % or 45 wt % to about 50 wt %, 55 wt % or 60 wt % of tobacco extract (DWB). For example, the amorphous solid may comprise 20-60 wt %, 40-55 wt % or 45-50 wt % of tobacco extract. The tobacco extract may contain nicotine at a concentration such that the amorphous solid comprises from about 1 wt % 1.5 wt % or 2 wt % to about 6 wt %, 5 wt %, 4 wt % or 3 wt % of nicotine (DWB). In some cases, there may be no nicotine in the amorphous solid other than that which results from the tobacco extract.

In some cases, the tobacco extract may be an aqueous extract, obtained by extraction with water. The tobacco extract may be an extract from any suitable tobacco, such as single grades or blends, cut rag or whole leaf, including Virginia and/or Burley and/or Oriental. It may also be an extract from tobacco particle 'fines' or dust, expanded tobacco, stems, expanded stems, and other processed stem materials, such as cut rolled stems. The extract may be obtained from a ground tobacco or a reconstituted tobacco material.

In some cases, the amorphous solid may comprise a flavor. Suitably, the amorphous solid may comprise up to about 60 wt %, 50 wt %, 40 wt %, 30 wt %, 20 wt %, 10 wt % or 5 wt % of a flavor. In some cases, the amorphous solid may comprise at least about 0.1 wt %, 0.5 wt %, 1 wt %, 2 wt %, 5 wt % 10 wt %, 20 wt % or 30 wt % of a flavor (all calculated on a dry weight basis). For example, the amorphous solid may comprise 0.1-60 wt %, 1-60 wt %, 5-60 wt %, 10-60 wt %, 20-50 wt % or 30-40 wt % of a flavor. In some cases, the flavor (if present) comprises, consists essentially of or consists of menthol. In some cases, the amorphous solid does not comprise a flavor.

In some cases, the total content of active substance and/or flavor may be at least about 0.1 wt %, 1 wt %, 5 wt %, 10 wt %, 20 wt %, 25 wt % or 30 wt %. In some cases, the total content of active substance and/or flavor may be less than about 80 wt %, 70 wt %, 60 wt %, 50 wt % or 40 wt % (all calculated on a dry weight basis).

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In particular cases, the amorphous solid comprises no calcium carbonate such as chalk.

In particular embodiments which include filler, the filler is fibrous. For example, the filler may be a fibrous organic filler material such as wood pulp, hemp fiber, cellulose or cellulose derivatives. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosolizable material.

In some embodiments, the amorphous solid does not comprise tobacco fibers, In particular embodiments, the amorphous solid does not comprise fibrous material.

In some embodiments, the aerosol generating material does not comprise tobacco fibers. In particular embodiments, the aerosol generating material does not comprise fibrous material.

In some embodiments, the aerosol generating substrate does not comprise tobacco fibers. In particular embodiments, the aerosol generating substrate does not comprise fibrous material.

In some embodiments, the aerosol generating article does not comprise tobacco fibers. In particular embodiments, the aerosol generating article does not comprise fibrous material.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the aerosol generating material is formed as a sheet and then shredded and incorporated into an aerosol generating article. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the aerosol generating material is included in an aerosol generating article/assembly as a rolled sheet, suitably in the form of a tube.

The aerosol generating material comprising the amorphous solid may have any suitable area density, such as from 30 $g/m^2$ to 120 $g/m^2$. In some embodiments, aerosol generating material may have an area density of from about 30 to 70 $g/m^2$, or about 40 to 60 $g/m^2$. In some embodiments, the amorphous solid may have an area density of from about 80 to 120 $g/m^2$, or from about 70 to 110 $g/m^2$, or particularly from about 90 to 110 $g/m^2$. Such area densities may be particularly suitable where the aerosol-generating material is included in an aerosol generating article/assembly in sheet form, or as a shredded sheet (described further hereinbelow).

In some cases, the amorphous solid may consist essentially of, or consist of a gelling agent, an aerosol generating agent a tobacco extract, water, and optionally a flavor. In some cases, the amorphous solid may consist essentially of, or consist of glycerol, alginates and/or pectins, a tobacco extract and water.

In some cases, the aerosol-generating substrate may additionally comprise a carrier on which the amorphous solid is provided. This carrier may ease manufacture and/or handling through, for example, (a) providing a surface onto which a slurry may be applied (e.g. by casting, spraying or extruding), (and which the slurry does not need to be separated from later), (b) providing a non-tacky surface for the aerosol generating material, (c) providing some rigidity to the material.

In some cases, the carrier may be formed from materials selected from metal foil, paper, carbon paper, greaseproof paper, ceramic, carbon allotropes such as graphite and graphene, plastic, cardboard, wood or combinations thereof. In some cases, the carrier may be formed from materials selected from metal foil, paper, cardboard, wood or combinations thereof. In some cases, the carrier itself be a laminate structure comprising layers of materials selected from the preceding lists. In some cases, the carrier be impregnated with a flavorant or with further tobacco extract.

In some cases, the carrier may be substantially or wholly impermeable to gas and/or aerosol. This prevents aerosol or gas passage through the carrier in use, thereby controlling the flow and ensuring it is delivered to the user. This can also be used to prevent condensation or other deposition of the gas/aerosol in use on, for example, the surface of a heater provided in an aerosol generating assembly. Thus, consumption efficiency and hygiene can be improved in some cases.

In some cases, the carrier in the aerosol generating article may comprise or consist of a porous layer that abuts the amorphous solid. For example, the porous layer may be a paper layer. In some particular cases, the amorphous solid is disposed in direct contact with the porous layer; the porous layer abuts the amorphous and forms a strong bond. The amorphous solid is formed by drying a gel and, without being limited by theory, it is thought that the slurry from which the gel is formed partially impregnates the porous layer (e.g. paper) so that when the gel sets and forms cross-links, the porous layer is partially bound into the gel. This provides a strong binding between the gel and the porous layer (and between the dried gel and the porous layer).

Additionally, surface roughness may contribute to the strength of bond between the amorphous material and the carrier. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the carrier facing away from the amorphous solid may be arranged in contact with the heater, and a smoother surface may provide more efficient heat transfer. Thus, in some cases, the carrier is disposed so as to have a rougher side abutting the amorphous material and a smoother side facing away from the amorphous material.

In one particular case, the carrier may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the paper-backed foil abuts the amorphous solid. The foil is substantially impermeable, thereby preventing water provided in the amorphous solid to be absorbed into the paper which could weaken its structural integrity.

In some cases, the carrier is formed from or comprises metal foil, such as aluminum foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

In some cases, the carrier may be magnetic. This functionality may be used to fasten the carrier to the assembly in use, or may be used to generate particular amorphous solid shapes. In some cases, the aerosol-generating substrate may comprise one or more magnets which can be used to fasten the substrate to an induction heater(s) in use.

In some cases, the aerosol-generating substrate may comprise heating means embedded in the amorphous solid, such as resistive or inductive heating elements.

In some cases, the amorphous solid may have a thickness of from about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

The inventors have established that if the amorphous solid is too thick, then heating efficiency and aerosol delivery are compromised. This adversely affects the power consumption in use. Conversely, if the amorphous solid is too thin, it is difficult to manufacture and handle; a very thin material is harder to cast and may be fragile, compromising aerosol formation in use.

The inventors have established that the amorphous solid thicknesses stipulated herein optimize the material properties in view of these competing considerations. The thickness stipulated herein is a mean thickness for the material. In some cases, the amorphous solid thickness may vary by no more than 25%, 20%, 15%, 10%, 5% or 1%.

The amorphous solid may be incorporated into the aerosol-generating substrate as a single monolith in which different sections of the monolith are heated separately. In some such cases, the amorphous solid may be in the form of a sheet.

In cases where the amorphous solid is in the form of a sheet, the amorphous solid may be included as a planar sheet, as a bunched or gathered sheet, as a crimped sheet, or as a rolled sheet (i.e. in the form of a tube). In some such cases, the amorphous solid of these embodiments may be included in an aerosol generating article/assembly as a sheet, such as a sheet circumscribing a rod of aerosolizable material (e.g. tobacco). In some other cases, the aerosol generating material may be formed as a sheet and then shredded and incorporated into the article. In some cases, the shredded sheet may be mixed with cut rag tobacco and incorporated into the article.

In other cases, the amorphous solid may be incorporated in a plurality of discrete sections in the aerosol-generating substrate, each of which is located in a separate heating zone.

The amorphous solid material may be made by a method comprising the steps of (a) forming a slurry comprising components of the amorphous solid material, (b) forming a layer of the slurry, (c) setting the slurry to form a gel, and (d) drying the gel to form an amorphous solid.

The step (b) of forming a layer of the slurry may comprise spraying, casting or extruding the slurry, for example. In some cases, the layer is formed by electrospraying the slurry. In some cases, the layer is formed by casting the slurry.

In some cases, the steps (b) and/or (c) and/or (d) may, at least partially, occur simultaneously (for example, during electrospraying). In some cases, these steps may occur sequentially.

In some cases, the step (c) of setting the gel may comprise the addition of a setting agent to the slurry. For example, the slurry may comprise sodium, potassium or ammonium alginate as a gelling agent, and a setting agent comprising a calcium source (such as calcium chloride), may be added to the slurry to form a calcium alginate gel.

The total amount of the setting agent, such as a calcium source, may be 0.5-5 wt % (calculated on a dry weight basis). The inventors have found that the addition of too little setting agent may result in an amorphous solid which does not stabilize the amorphous solid components and results in these components dropping out of the amorphous solid. The inventors have found that the addition of too much setting agent results in an amorphous solid that is very tacky and consequently has poor handleability.

In some cases however, no setting agent is needed; the tobacco extract may contain sufficient calcium to effect gelation.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the gel-precursor pay comprise an alginate salt in which at least about 40%, 45%, 50%, 55%, 60% or 70% of the monomer units in the alginate copolymer are α-L-guluronic acid (G) units.

The slurry itself may also form part of the invention. In some cases, the slurry solvent may consist essentially of or consist of water. In some cases, the slurry may comprise from about 50 wt %, 60 wt %, 70 wt %, 80 wt % or 90 wt % of solvent (WWB).

In some examples, the slurry has a viscosity of from about 10 to about 20 Pa·s at 46.5° C., such as from about 14 to about 16 Pa·s at 46.5° C.

In cases where the solvent consists of water, the dry weight content of the slurry may match the dry weight content of the amorphous solid. Thus, the discussion herein relating to the solid composition is explicitly disclosed in combination with the slurry aspect of the invention.

Exemplary Embodiments of Amorphous Solid

In some embodiments, the amorphous solid comprises menthol.

Particular embodiments comprising a menthol-containing amorphous solid may be particularly suitable for including in an aerosol generating article/assembly as a shredded sheet. In these embodiments, the amorphous solid may have the following composition (DWB): gelling agent (preferably comprising alginate, more preferably comprising a combination of alginate and pectin) in an amount of from about 20 wt % to about 40 wt %, or about 25 wt % to 35 wt %; menthol in an amount of from about 35 wt % to about 60 wt %, or from about 40 wt % to 55 wt %; aerosol generating agent (preferably comprising glycerol) in an amount of from about 10 wt % to about 30 wt %, or from about 15 wt % to about 25 wt % (DWB).

In one embodiment, the amorphous solid comprises about 32-33 wt % of an alginate/pectin gelling agent blend; about 47-48 wt % menthol flavorant; and about 19-20 wt % glycerol aerosol generating agent (DWB).

As noted above, the amorphous solid of these embodiments may be included in an aerosol generating article/assembly as a shredded sheet. The shredded sheet may be provided in the article/assembly blended with cut tobacco. Alternatively, the amorphous solid may be provided as a non-shredded sheet. Suitably, the shredded or non-shredded sheet has a thickness of from about 0.015 mm to about 1 mm, preferably from about 0.02 mm to about 0.07 mm.

Particular embodiments of the menthol-containing amorphous solid may be particularly suitable for including in an aerosol generating article/assembly as a sheet, such as a sheet circumscribing a rod of aerosolizable material (e.g. tobacco). In these embodiments, the amorphous solid may have the following composition (DWB): gelling agent (preferably comprising alginate, more preferably comprising a combination of alginate and pectin) in an amount of from about 5 wt % to about 40 wt %, or about 10 wt % to 30 wt %; menthol in an amount of from about 10 wt % to about 50 wt %, or from about 15 wt % to 40 wt %; aerosol generating agent (preferably comprising glycerol) in an amount of from about 5 wt % to about 40 wt %, or from about 10 wt % to about 35 wt %; and optionally filler in an amount of up to 60 wt %—for example, in an amount of from 5 wt % to 20 wt %, or from about 40 wt % to 60 wt % (DWB).

In one of these embodiments, the amorphous solid comprises about 11 wt % of an alginate/pectin gelling agent blend, about 56 wt % woodpulp filler, about 18% menthol flavorant and about 15 wt % glycerol (DWB).

In another of these embodiments, the amorphous solid comprises about 22 wt % of an alginate/pectin gelling agent blend, about 12 wt % woodpulp filler, about 36% menthol flavorant and about 30 wt % glycerol (DWB).

As noted above, the amorphous solid of these embodiments may be included as a sheet. In one embodiment, the sheet is provided on a carrier comprising paper. In one embodiment, the sheet is provided on a carrier comprising metal foil, suitably aluminum metal foil. In this embodiment, the amorphous solid may abut the metal foil.

In one embodiment, the sheet forms part of a laminate material with a layer (preferably comprising paper) attached to a top and bottom surface of the sheet. Suitably, the sheet of amorphous solid has a thickness of from about 0.015 mm to about 1 mm.

In some embodiments, the amorphous solid comprises a flavorant which does not comprise menthol. In these embodiments, the amorphous solid may have the following composition (DWB): gelling agent (preferably comprising alginate) in an amount of from about 5 to about 40 wt %, or from about 10 wt % to about 35 wt %, or from about 20 wt % to about 35 wt %; flavorant in an amount of from about 0.1 wt % to about 40 wt %, of from about 1 wt % to about 30 wt %, or from about 1 wt % to about 20 wt %, or from about 5 wt % to about 20 wt %; aerosol generating agent (preferably comprising glycerol) in an amount of from 15 wt % to 75 wt %, or from about 30 wt % to about 70 wt %, or from about 50 wt % to about 65 wt %; and optionally filler (suitably woodpulp) in an amount of less than about 60 wt %, or about 20 wt %, or about 10 wt %, or about 5 wt % (preferably the amorphous solid does not comprise filler) (DWB).

In one of these embodiments, the amorphous solid comprises about 27 wt % alginate gelling agent, about 14 wt % flavorant and about 57 wt % glycerol aerosol generating agent (DWB).

In another of these embodiments, the amorphous solid comprises about 29 wt % alginate gelling agent, about 9 wt % flavorant and about 60 wt % glycerol (DWB).

The amorphous solid of these embodiments may be included in an aerosol generating article/assembly as a shredded sheet, optionally blended with cut tobacco. Alternatively, the amorphous solid of these embodiments may be included in an aerosol generating article/assembly as a sheet, such as a sheet circumscribing a rod of aerosolizable material (e.g. tobacco). Alternatively, the amorphous solid of these embodiments may be included in an aerosol generating article/assembly as a layer portion disposed on a carrier.

In some embodiments, the amorphous solid comprises tobacco extract. In these embodiments, the amorphous solid may have the following composition (DWB): gelling agent (preferably comprising alginate) in an amount of from about 5 wt % to about 40 wt %, or about 10 wt % to 30 wt %, or about 15 wt % to about 25 wt %; tobacco extract in an amount of from about 30 wt % to about 60 wt %, or from about 40 wt % to 55 wt %, or from about 45 wt % to about 50 wt %; aerosol generating agent (preferably comprising glycerol) in an amount of from about 10 wt % to about 50 wt %, or from about 20 wt % to about 40 wt %, or from about 25 wt % to about 35 wt % (DWB).

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

The amorphous solid of these embodiments may be included in an aerosol generating article/assembly as a shredded sheet, optionally blended with cut tobacco. Alternatively, the amorphous solid of these embodiments may be included in an aerosol generating article/assembly as a sheet, such as a sheet circumscribing a rod of aerosolizable material (e.g. tobacco). Alternatively, the amorphous solid of these embodiments may be included in an aerosol generating article/assembly as a layer portion disposed on a carrier. Suitably, in any of these embodiments, the amorphous solid has a thickness of from about 50 μm to about 200 μm, or about 50 μm to about 100 μm, or about 60 μm to about 90 μm, suitably about 77 μm.

The slurry for forming this amorphous solid may also form part of the invention. In some cases, the slurry may have an elastic modulus of from about 5 to 1200 Pa (also referred to as storage modulus); in some cases, the slurry may have a viscous modulus of about 5 to 600 Pa (also referred to as loss modulus).

Definitions

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine.

In some embodiments, the active substance comprises caffeine, melatonin or vitamin B12.

As noted herein, the active substance may comprise one or more constituents, derivatives or extracts of *cannabis*, such as one or more cannabinoids or terpenes.

Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as *cannabis*, from animals (endocannabinoids), or artificially manufactured (synthetic cannabinoids). *Cannabis* species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in *cannabis* include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha spicata crispa, Mentha cordifolia, Mentha longifolia, Mentha suaveolens variegata, Mentha pulegium, Mentha spicata* c.v. and *Mentha suaveolens*.

In some embodiments, the botanical is selected from *eucalyptus*, star anise, cocoa and hemp.

In some embodiments, the botanical is selected from rooibos and fennel.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

The flavor may suitably comprise one or more mint-flavors suitably a mint oil from any species of the genus *Mentha*. The flavor may suitably comprise, consist essentially of or consist of menthol.

In some embodiments, the flavor comprises menthol, spearmint and/or peppermint.

In some embodiments, the flavor comprises flavor components of cucumber, blueberry, citrus fruits and/or redberry.

In some embodiments, the flavor comprises eugenol.

In some embodiments, the flavor comprises flavor components extracted from tobacco.

In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

As used herein, the term "aerosol generating agent" refers to an agent that promotes the generation of an aerosol. An aerosol generating agent may promote the generation of an aerosol by promoting an initial vaporization and/or the condensation of a gas to an inhalable solid and/or liquid aerosol.

Suitable aerosol generating agents include, but are not limited to: a polyol such as erythritol, sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of or consist of glycerol.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

To the extent that they are compatible, features disclosed herein in relation to one aspect of the invention are explicitly disclosed in combination with each and every other aspect.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A method of generating aerosol from an aerosol-generating substrate using an aerosol-generating device, the aerosol-generating device comprising at least three heating zones disposed so as to each heat a different section of the substrate to generate an aerosol without burning;

the method comprising sequentially generating aerosol from each different section of substrate, wherein during heating:

a first section of substrate is heated to an aerosol-generation temperature;

another section of substrate is heated to an intermediate temperature which is below the aerosol-generation temperature and above the minimum operating temperature;

at least one of the remaining sections of substrate are heated to a minimum operating temperature which is at least sufficient to prevent condensation of volatilized components on or in the vicinity of those sections;

and wherein once aerosol has been generated from the first section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

2. A method according to claim 1, wherein each section of the different sections of the substrate provides aerosol for one puff.

3. A method according to claim 1, wherein each section of the different sections of the substrate provides aerosol for two or more puffs.

4. A method according to claim 1, wherein the substrate comprises an amorphous solid.

5. A method according to claim 4, wherein the amorphous solid comprises:

1-60 wt % of a gelling agent;

5-80 wt % of an aerosol generating agent; and 0.1-60 wt % of at least one active substance and/or flavorant;

wherein these weights are calculated on a dry weight basis.

6. An aerosol-generating device for generating aerosol from an aerosol-generating substrate by heating the substrate without burning, wherein the device comprises at least three heating zones, each disposed to heat a different section of the aerosol-generating substrate, wherein the device is configured such that in use:

a first section of substrate is heated to an aerosol-generation temperature;

another section of substrate is heated to an intermediate temperature which is below the aerosol-generation temperature and above the minimum operating temperature;

at least one of the remaining sections of substrate are heated to a minimum operating temperature which is at least sufficient to prevent condensation of volatilized components on or in the vicinity of those sections;

and wherein once aerosol has been generated from the first section, (a) the temperature in that section is reduced from the aerosol-generation temperature to the minimum operating temperature, (b) the section previously heated to the intermediate temperature is heated to the aerosol-generation temperature, and (c) a further section is heated to the intermediate temperature.

7. An aerosol-generating device according to claim 6, comprising 4, 5, 6, 7, 8 or 9 heating zones, each disposed to heat a different section of the aerosol-generating substrate in use.

8. An aerosol-generating device according to claim 6, wherein the device comprises one heater corresponding to each heating zone, which is configured to heat but not burn the substrate.

9. An aerosol-generating device according to claim 6, wherein the device is configured to heat a solid aerosol-generating substrate.

10. An aerosol-generating assembly comprising an aerosol-generating device according to claim 6 and an aerosol-generating substrate.

11. An aerosol-generating assembly according to claim 10, wherein each different section of the substrate provides aerosol for one puff.

12. An aerosol-generating assembly according to claim 10, wherein each different section of the substrate provides aerosol for two or more puffs.

13. An aerosol-generating assembly according to claim 10, wherein the substrate comprises an amorphous solid.

14. An aerosol-generating assembly according to claim 13, wherein the amorphous solid comprises:

1-60 wt % of a gelling agent; and/or 5-80 wt % of an aerosol generating agent; and/or 0.1-60 wt % of at least one active substance and/or flavorant;

wherein these weights are calculated on a dry weight basis.

15. An aerosol generating assembly according to claim 10, wherein the assembly is a heat not burn product.

* * * * *